US008226134B2

(12) United States Patent
O'Donnell

(10) Patent No.: US 8,226,134 B2
(45) Date of Patent: Jul. 24, 2012

(54) TOOL HEAD AND LOG HANDLING TOOL

(76) Inventor: James R. O'Donnell, Bartlett, NH (US)

( * ) Notice: Subject to any disclaimer, the term of this patent is extended or adjusted under 35 U.S.C. 154(b) by 0 days.

(21) Appl. No.: 13/021,553

(22) Filed: Feb. 4, 2011

(65) Prior Publication Data

US 2011/0193360 A1 Aug. 11, 2011

Related U.S. Application Data

(60) Provisional application No. 61/302,411, filed on Feb. 8, 2010.

(51) Int. Cl.
*F24B 15/10* (2006.01)

(52) U.S. Cl. ..... 294/11; 294/211

(58) Field of Classification Search ..... 294/11, 294/14, 19.2, 175, 211, 210, 22, 23, 24
See application file for complete search history.

(56) References Cited

U.S. PATENT DOCUMENTS 149,575 A * 4/1874 Clendaniel et al. ..... 294/211
551,433 A * 12/1895 Cozens ..... 294/211
1,742,727 A * 1/1930 Richards ..... 294/14
1,857,841 A * 5/1932 Engel ..... 294/11
3,014,749 A * 12/1961 Carrow ..... 294/26
D254,704 S * 4/1980 Hammond ..... D8/51
4,240,657 A * 12/1980 Feighery ..... 294/11
4,248,464 A * 2/1981 Cross ..... 294/9
4,354,702 A * 10/1982 Clements et al. ..... 294/9
D341,525 S * 11/1993 Bernhard ..... D8/1
6,457,756 B2 * 10/2002 Pronesky et al. ..... 294/11
7,344,170 B2 * 3/2008 Ingram ..... 294/11
2005/0184541 A1 * 8/2005 Grizzle ..... 294/19.1

* cited by examiner

*Primary Examiner* — Saul Rodriguez
*Assistant Examiner* — Gabriela Puig
(74) *Attorney, Agent, or Firm* — Michael J. Persson; Catherine E. Napjus; Lawson Perrson & Weldon-Granike

(57) ABSTRACT

A tool head including a metal, generally U-shaped body with two tines and a curved area, and a metal rod integral to and extending from the curved area of the U-shaped head. Each of the two tines has a tip, a tine body, and an end that joins with the curved area. One tip is straight and one tip is angled so that the angled tip is not coplanar with the plane defined by the tine bodies of the two tines. A tool including the tool head, a handle with a ferrule end and a non-ferrule end, where the handle is integral to the metal rod of the tool head at the ferrule end, and a metal ferrule integral to the handle at the ferrule end of the handle.

19 Claims, 8 Drawing Sheets

TOOL HEAD AND LOG HANDLING TOOL

CLAIM OF PRIORITY

This application claims the benefit of priority of U.S. Provisional Patent Application No. 61/302,411, filed on Feb. 8, 2010.

FIELD OF THE INVENTION

The present invention relates to log handling tools, and in particular, to an improved tool for lifting and moving logs.

BACKGROUND

Fires in domestic or commercial fireplaces, camp fires, and wood fired ovens are widely used for warmth, aesthetics, and recreation. Any of such fires require burning wood and tending to the fire. Often there is a more optimal position for a log of wood for creating the most intense fire, creating a fire that evenly distributes heat over a certain area, or for safety reasons, such as if a log has fallen too far toward or out of an edge of the designated fire area. In any of these situations, the log should be moved but, as the log is on fire or at least very hot, in most cases, it would be dangerous to move the log directly with one's hands. Many fire tools have been developed to move logs. In addition to pokers, which can be used to poke or shift logs, but not to lift them up, many tools have been developed for actually lifting logs.

Some fireplace tools are designed so that a log may rest on top of the tool, assuming the log is properly balanced. Such a tool is disclosed in U.S. Pat. No. 4,240,657 to Feighery, which includes three tines. Unfortunately this tool has significant drawbacks. First, it is difficult to position both tines under the log, especially as the top tine reduces the leverage the user has to angle the bottom tines under the log. In addition, the design of the tool is such that a user would need to extend his arms directly over the fire in order to properly position the tines, which could result in the user being burned. Other similar tools, such as those described in U.S. Pat. Nos. 4,354,702 and 4,248,464, which include two tines that are designed such that both are inserted under the log so that the log may be lifted, are similarly disadvantaged insofar as it is difficult to get more than one tine under a log without pushing the log away. Moreover, they also suffer the difficulty of adequately balancing the log on top of the tool, assuming the user is able to get the tines under the log in the correct position. Finally, the tines on each of these tools do not include any details that prevent a log from rolling off of the tines or that could be used to turn a burning log that is resting in a fireplace or fire pit.

Other fireplace tools are designed to grasp a log, thereby eliminating the need to balance the log on top of the tool. Examples of such tools are shown in U.S. Pat. Nos. 1,742,727, 1,857,841, 6,457,756, and D254,704. Other such tools are often included in fireplace tool sets and generally include one piece with two tines that is held with one hand and another piece with one tine that is held with the other hand. The two pieces are connected so that when the user opens and closes his hands, the two tines of the one piece and the one tine of the other piece act as jaws that may be used to grasp and/or lift a fire log. Each of these tools are disadvantaged in that the grasp on the fire log is often tenuous and awkward.

A variation on such tools is disclosed in U.S. Pat. No. 7,344,170 to Ingram. This patent discloses a friction grip fireplace tool comprising a rod or bar, having a hand grip on one end, and on the other end a resilient, unary, v-shaped open-jawed mouth to grip, lift, and reposition logs in a fireplace. This tool is disadvantaged in that there may not be sufficient grip on the log to confidently move it, and even if there is sufficient grip, as the log is gripped in only one place, it may wobble unsafely from side to side.

Therefore there is a need for a fireplace tool that requires only one tine to be inserted under a log to gain control of the log and that gives the user a relatively secure hold of the log.

SUMMARY OF THE INVENTION

The present invention includes a tool head and a tool that utilizes the tool head. In its most basic form, the tool head of the present invention includes a metal, generally U-shaped body with two tines protruding from either side of a curved area and a metal rod integral to and extending from the curved area. Each of the two tines of the U-shaped body has a tip having a tip end, a tine body, and a tine end that joins with the curved area. One of the tips of the tines has an angle that causes the tip to be non-coplanar with the plane defined by the two tine bodies.

It is preferred that the U-shaped body be formed of at least 5/16 inch rolled steel with a total length from tip to tip of approximately eighteen inches. It is preferred that the metal rod include threading, and is preferably a 3/8 inch by three inch steel lag screw with the screw's head welded to the center of the U-shaped body. In some preferred embodiments, the metal rod also includes a metal shank between the U-shaped body and the threaded portion of the metal rod. In such embodiments, one end of the metal shank is welded to the center of the U-shaped body and the other end is welded to the head of the steel lag screw. The shank is preferably approximately six inches long, but may be longer or shorter. In all embodiments, the tool head of the present invention is a single integrated piece.

It is preferred that the angle at the end of the angled tip be approximately 90°, but may range between 75° and 100°. The angle preferably occurs approximately one inch from the tip end of the angled tine, but may occur greater than or less than one inch from the tip end. It is also preferred that there be an angle where the tines meet the curved area. The angle is preferably between 150° and 160°. During manufacture of the tool head, both tips are slightly flattened, deburred, and shaped. The angled tip is preferably rounded. The straight tip may be rounded as well, or may have a similar blunted shape.

The distance between the two tines must be at least as wide as a cross section of an average log at an angle of between 45° and 85°. That is to say, if you stood an average log on its end, perpendicular from the ground, and then tilted it so it was only 45° and 85° from the ground, the distance between the two tines of the tool head of the present invention would have to be at least as wide as that cross section of the log parallel to the ground. This width is preferably between three inches and seven inches.

The tool head may be painted or otherwise adorned, such as with a maker's name or logo etched, or otherwise apparent, somewhere on the tool head.

In its most basic form, the tool of the present invention includes a tool head of the present invention, as described above, a handle attachable to the metal rod of the tool head, and a metal ferrule integral to the handle.

The handle is necessary to manipulate the tool head so as to tend a fire and lift a piece of wood. The handle is preferably made of a hardwood, but may be made of other materials such as soft wood, aluminum, or other metals, or fiberglass, and is not limited to these listed materials. The handle is preferably 1 1/8 inch by forty two inches, but may be shorter or longer, as well as thicker or less thick. Cosmetic treatments may be added to the handle, such as painting, staining, branding or other finishing.

The handle includes a non-ferrule end and a ferrule end where the metal ferrule is attached to the handle. The ferrule end must be tapered so as to allow the metal ferrule to be fitted. The metal ferrule may be glued onto or crimped onto the handle, or both, at the ferrule end. A pilot hole is drilled into the ferrule end of the handle so as to allow the threaded metal rod of the tool head to be screwed into the handle for attachment. Glue may be used in the pilot hole for added adhesion between the tool head and the handle. The non-ferrule end of the handle is preferably domed in shape, but may take different shapes, such as being shaped so as to have a blunt finished end.

In some embodiments, the handle has more than one section and connections between the sections so that the handle may be connected, disconnected, and reconnected. The connections are preferably hardware, such as screws, but may be any type of connection commonly used for such applications. Having a handle that may be broken down into two or more connections allows for easier storage.

In a preferred embodiment of the tool, the handle also includes a hole drilled approximately 1" from the non-ferrule end and a lanyard threaded through the hole. In this manner, the tool may be hung while not in use. The lanyard is preferably made of a durable material, such as leather, rope, string, or plastic cord.

The use of a metal ferrule is preferred as it protects the handle from possibly being burnt by a fire and thus affecting the performance of the tool. The metal ferrule is preferably at least 4" long, but may be longer. The metal ferrule may be painted or otherwise adorned, such as with a maker's name or logo etched into the metal or otherwise apparent.

The tool of the present invention is a U-shaped metal tool head, resulting in two tines, attached to a wooden handle. One tine is straight and one tine is bent at its tip to a 90° angle. Using the handle, a user can place or guide a piece of firewood in between the tines, placing the bent tine under the wood and the straight tine on top. By then shifting the tool to left of center, the weight of the wood is to the right. Preferably keeping the non-ferrule end of the handle somewhat low, with the wood properly balanced, a user may easily lift up a piece of wood and place it back down anywhere in a fire. Because one tine is bent, it acts as a "backstop", keeping the piece of wood from falling off the tool. This configuration allows a user to push, pull, poke, prod, lift, flip, and draw a piece of wood back towards the user, thus generally tending a wood fire with ease. The tool is a wood fire tender, firewood poker/grabber, and lifter in one tool with no moving parts.

The tool can be used for several purposes in several scenarios. The tool can be used as a reaching device or grabber. Because it has a handle and one bent tine on the tool head, it can be used to reach and grab items and draw them back to the user. When unloading a cargo van, for example, a carton that is out of reach can be grabbed by the bent tine of the tool head and be brought into reach. It could also be used as part of an outdoor residential fireplace, in which case a user could tend those wood fires for entertaining guests seated around an outdoor fireplace or pit. It can be used to tend indoor fireplaces and woodstoves, being particularly helpful in tending top load wood stoves.

Therefore it is an aspect of the present invention to provide a tool head with two tines, one of which is bent, one of which is straight.

It is a further aspect of the present invention to provide a tool head with a metal rod that can be easily attached to a handle.

It is a further aspect of the present invention to provide a tool head whose tines are spaced to accommodate an average sized log at an angle.

It is a further aspect of the present invention to provide a tool head that may or may not include a shank to lengthen the tool head.

It is a further aspect of the present invention to provide a tool that allows a user to easily pick up a log.

It is a further aspect of the present invention to provide a tool that provides a backstop to keep a log balanced on the tool from slipping, thus giving the user a relatively secure hold on the log.

It is a further aspect of the present invention to provide a tool for maneuvering logs that requires only one tine to be maneuvered under the log.

These aspects of the present invention are not meant to be exclusive and other features, aspects, and advantages of the present invention will be readily apparent to those of ordinary skill in the art when read in conjunction with the following description and accompanying drawings.

DETAILED DESCRIPTION

Figure 1:
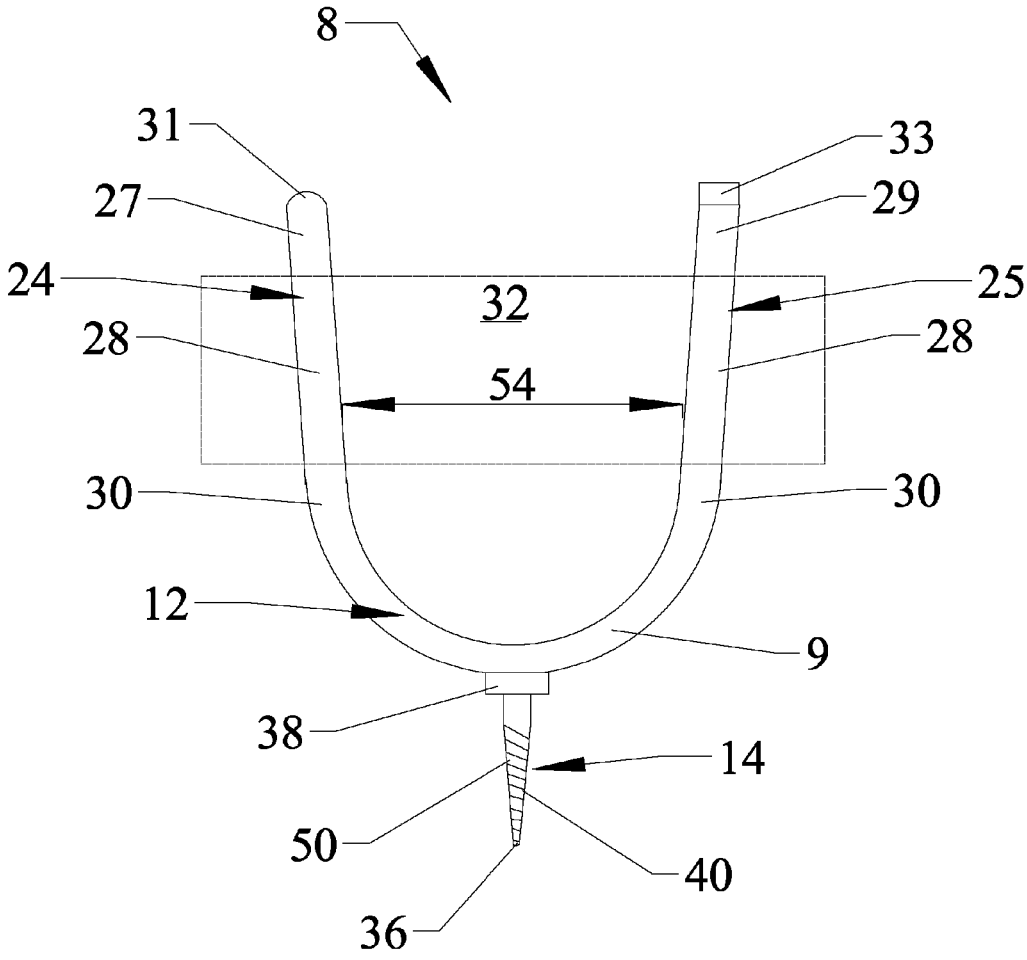
FIG. 1 is a top down view of the tool head of the present invention.
Figure 2:
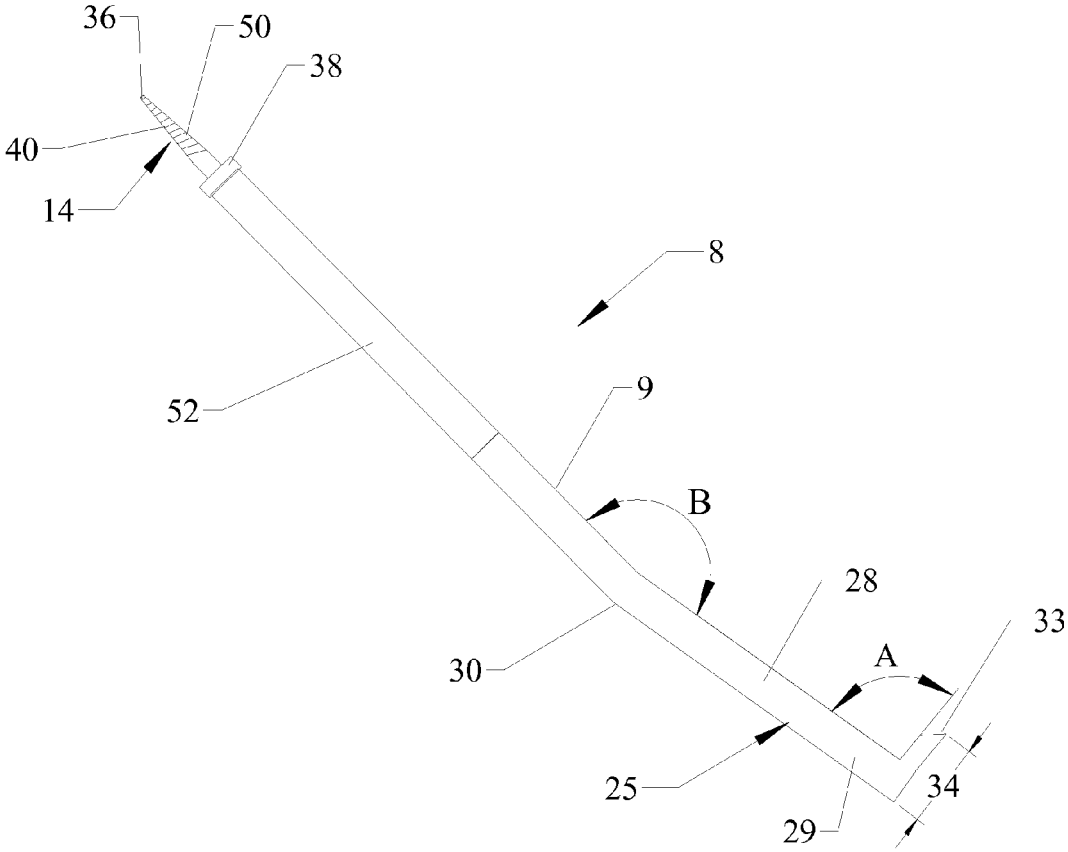
FIG. 2 is a side view of a tool head of the present invention including a shank.

FIGS. 1 and 2 show top and side views of tool head 8 of the present invention. Both Figures show U-shaped body 12 including tines 24, 25 and curved area 9, as well as metal rod 14. Tines 24, 25 each include tine bodies 28 and tine ends 30 that meet curved area 9. The left tine 24 includes left tip 27 that terminates in left tip end 31 and the right tine 25 includes right tip 29 that terminates in right tip end 33. These figures show metal rod 14 in its preferred embodiment of steel lag screw 50 having a threaded portion 40. Metal rod 14 also includes non-integral end 36 and integral end 38.

FIG. 1 shows both tines 24, 25. In this embodiment, the left tip 27 is a straight tip while the right tip 29 is and is an angled tip that is angled toward the viewer. However, this is for illustrative purposes and angled tip may be disposed on the left tine 24 and the straight tip may be disposed on the right tine 25. Both tips 27, 29 have been deburred, shaped, and slightly flattened. Plane 32 is indicated with dashed lines. Plane 32 is defined by tine bodies 28. Angle A (see FIG. 2) shows the right tip 29 angled out of plane 32.

Space 54 between tines 24, 25 is also indicated. Space 54 is an important feature for the functionality of the present invention. Space 54 must be wide enough to allow not only the introduction of an average fire log, but an average fire log at an angle. A log positioned directly between tines 24, 25 perpendicular to plane 32 would fall through tines 24, 25 so that the present invention would not work properly. There must be adequate room between tines 24, 25 for a log to be angled between tines 24, 25 as shown in FIG. 6C, for example. The present invention envisions the log lying across the right tine 25 with the log being bound by the left tine 24, with the right tip 29 acting as a backstop, as shown in FIG. 6D, for example. Therefore, space 54 must be at least as wide as the cross section of an average fire log that is at an angle of between 45° and 85° angle with plane 32. This space 54 is preferably between three inches and seven inches.

FIG. 2 includes shank 52 between metal rod 14 and curved area 9 of U-shaped body 12. The delineation between shank 52 and curved area 9 is shown by a dashed line. In this side view, we see only the right tine 25 with angled right tip 29. Angled right tip 29 is angled at angle A, which is substantially 90°, but may range between 75° and 100°. Angle A occurs at distance 34 from right tip end 33. Distance 34 is preferably approximately one inch. U-shaped body 12 is angled on either side at angle B where tine ends 30 of each tine 24, 25 join with curved area 9. Angle B is preferably in the range of between 150° and 160°, as this range of angles has been found to be ideal at helping the user gain leverage with the handle on the wood.

Figure 3:
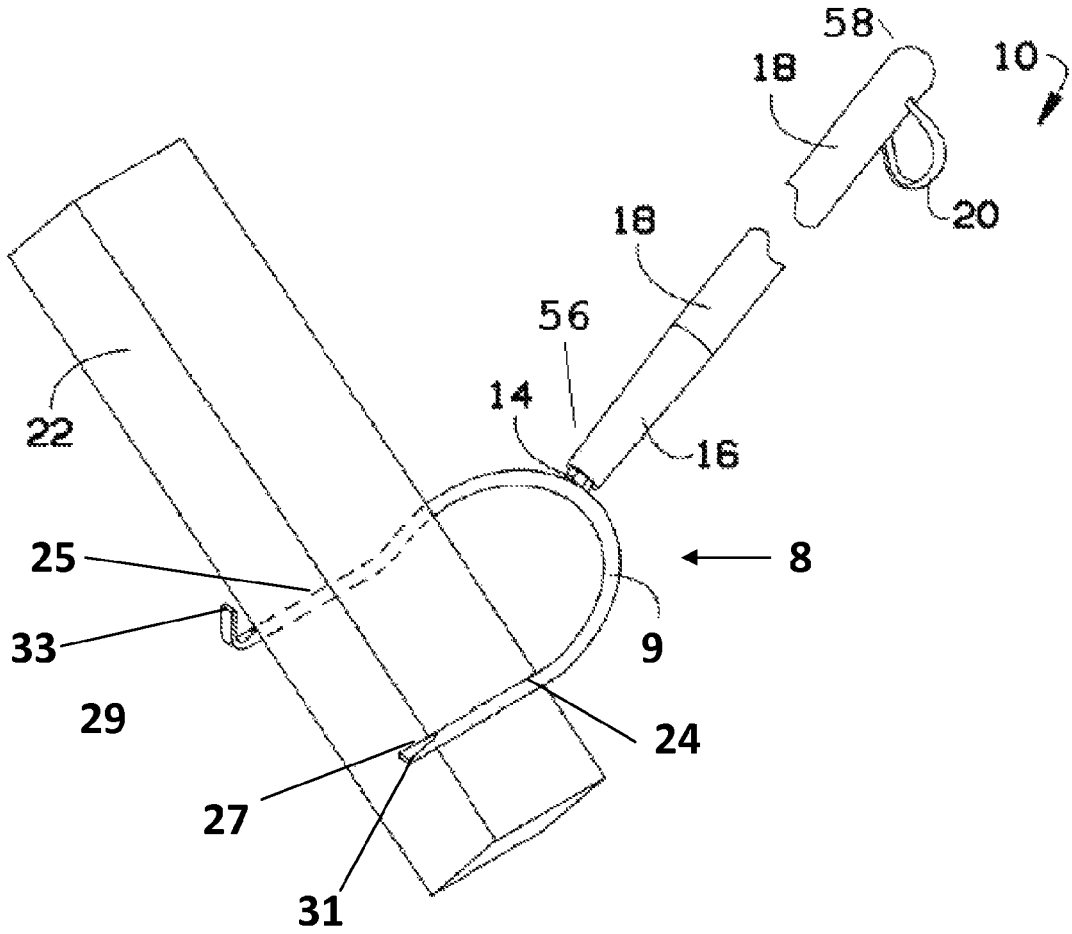
FIG. 3 is a perspective view of the tool of the present invention.

In embodiments in which the tines 24, 25 are not disposed at angle B from the curved area 9, the user has to place the non-ferrule end (See FIG. 3, Ref. No. 58) even lower to manipulate the wood and to place the right tine 25 under the wood. Further, when flipping the tool over to use it as a grabber, Angle B gives the user better leverage and aids with the provision of more downward pressure as the user manipulates the log.

Figure 4:
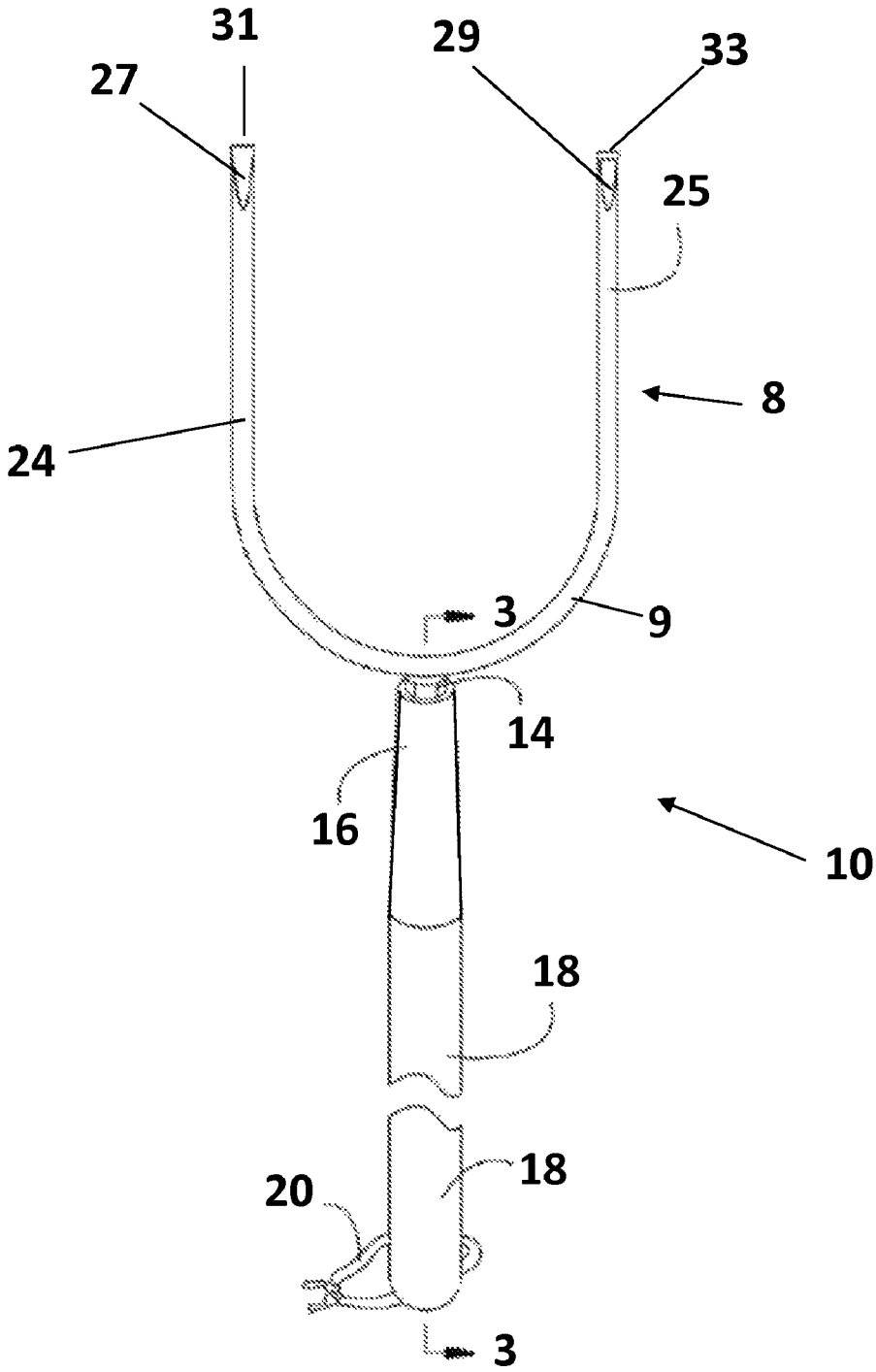
FIG. 4 is a plan view of the tool of the present invention.
Figure 5:
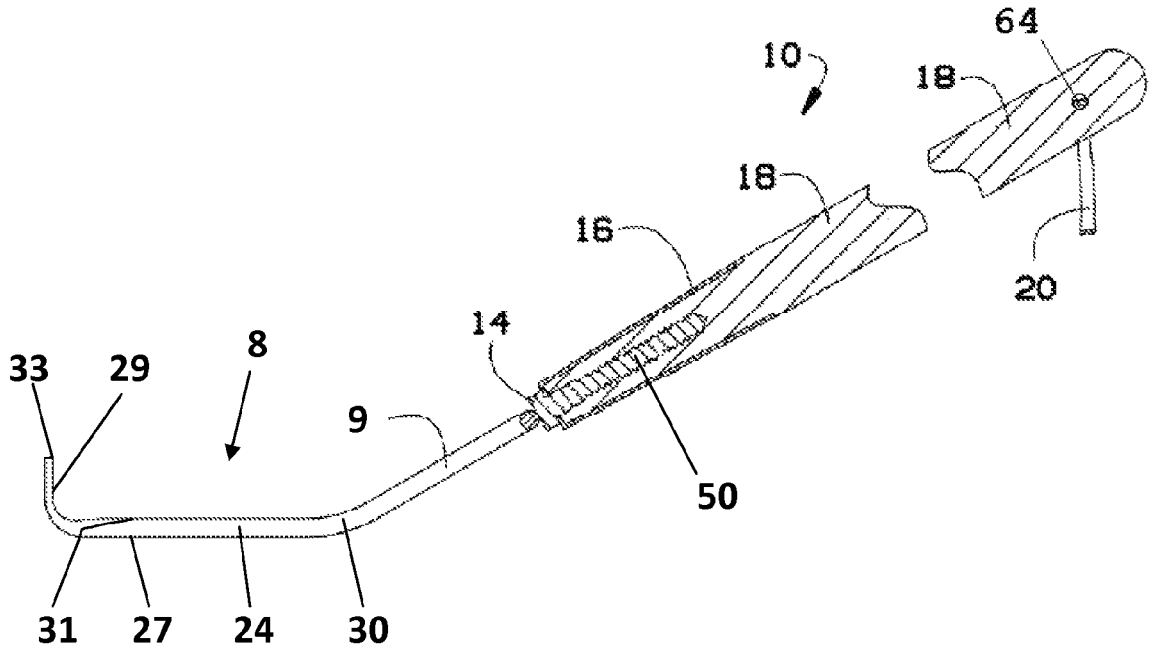
FIG. 5 is a section view of the tool of the present invention taken along line 3-3 in FIG. 4.

Now referring to FIGS. 3-5, tool 10 of the present invention is shown. Tool 10 includes tool head 8, handle 18, and metal ferrule 16. Handle 18 includes ferrule end 56, where metal ferrule 16 is disposed, and non-ferrule end 58. Handle 18 also preferably includes lanyard 20 attached through a hole 64 near non-ferrule end 58. FIG. 3 shows tool 10 holding log 22. Right tine 25 is shown in dashed lines to indicate that it is underneath of log 22. Left tine 24 is on top of and bracing log 22. Were log 22 to slip forward, it would be caught by the angled right tip 29 acting as a backstop. FIG. 4 shows a top down view of tool 10.

FIG. 5 is a cut away view of the tool 10 metal rod 14, which takes the form of lag screw 50, of tool head 8 affixed within handle 18. In embodiments in which the handle 18 is made of wood, the metal rod 14 is preferably the lag screw 50 shown in FIG. 5. However, in embodiments in which the handle is manufactured from other materials, such as metals or fiberglass, the metal rod 14 takes the form of a machine screw or includes locking details that frictionally lock the tool head 8 within the handle 18. In embodiments in which the end of the handle is made of a ferrous metal, the metal rod 14 may be affixed thereto by welding or brazing.

Figure 6A:
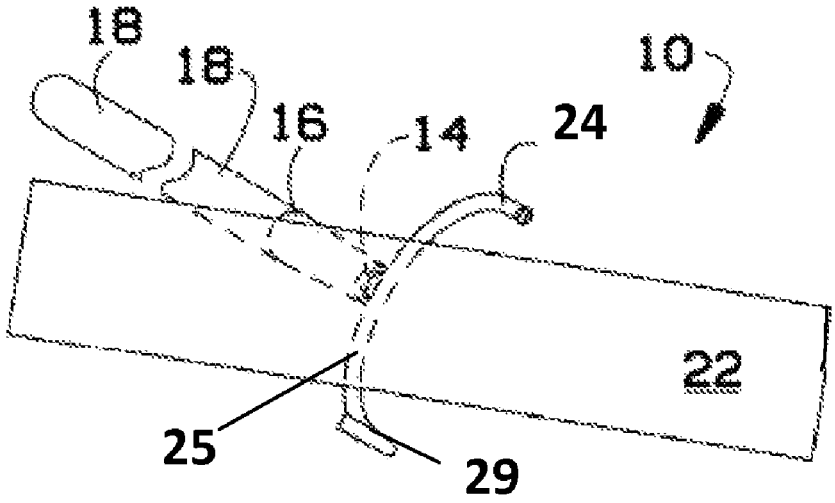
FIGS. 6A-6D are front views of the tool of the present invention in use.
Figure 6B:
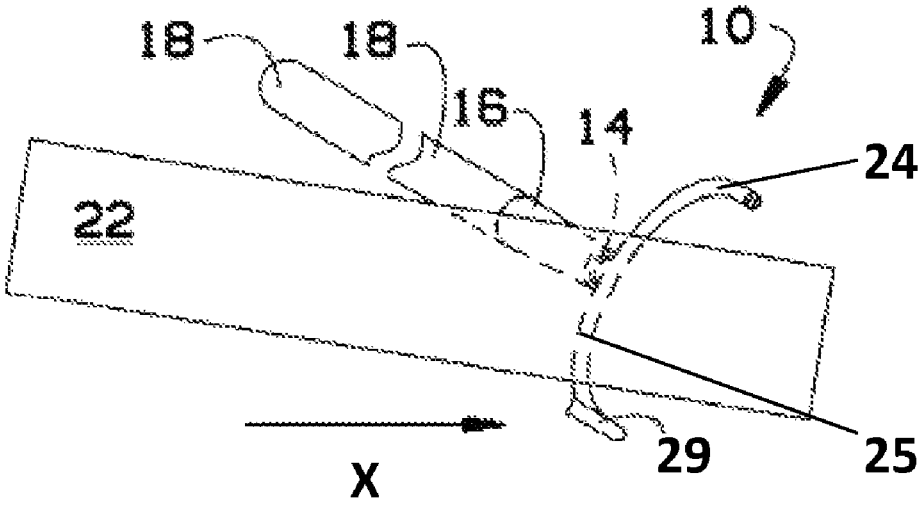
Figure 6C:
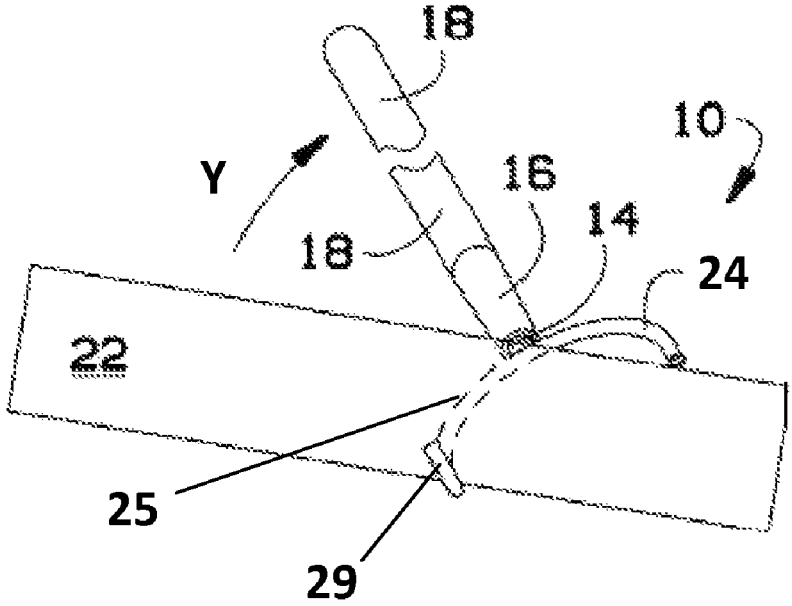
Figure 6D:
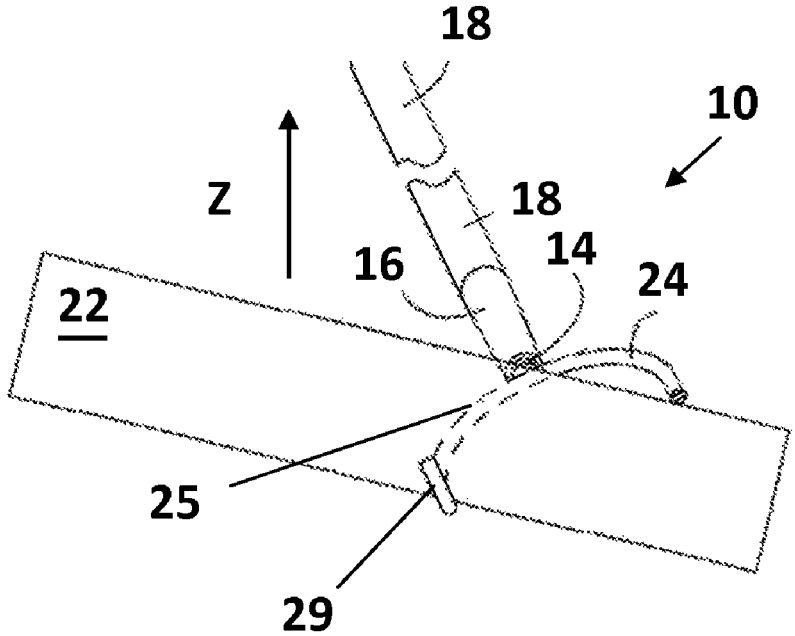

FIGS. 6A through 6D depict the lifting action of tool 10 lifting log 22. FIG. 6A illustrates the bent right tine 25 of tool head 8 placed under log 22 and the straight tine 24 on top of log 22. FIG. 6B illustrates tool head 8 shifted left of center of log 22 by moving the tool head 8 in the direction of arrow X. FIG. 6C illustrates tool head 8 rotated in the direction of arrow Y to contact log 22 in a proper position to lift the log 22. FIG. 6D illustrates tool 10 lifting log 22 by moving both the tool 10 and log 22 upward in the direction of arrow Z.

Figure 7A:
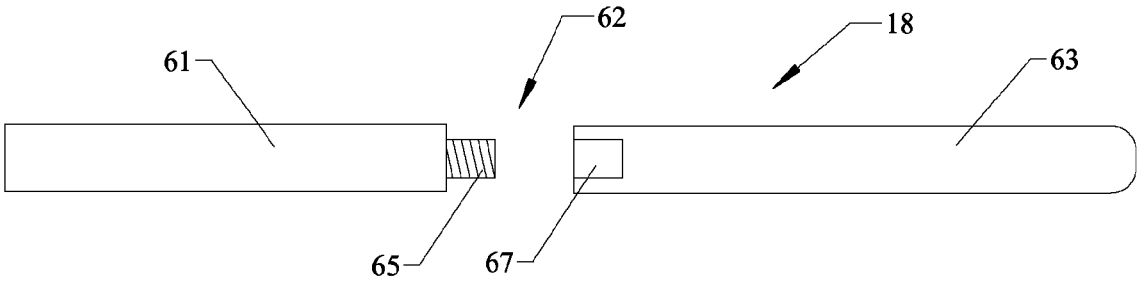
FIG. 7A is a side view of an unconnected sectioned handle of the tool of the present invention with the right section cut away to show the female threaded portion.
Figure 7B:
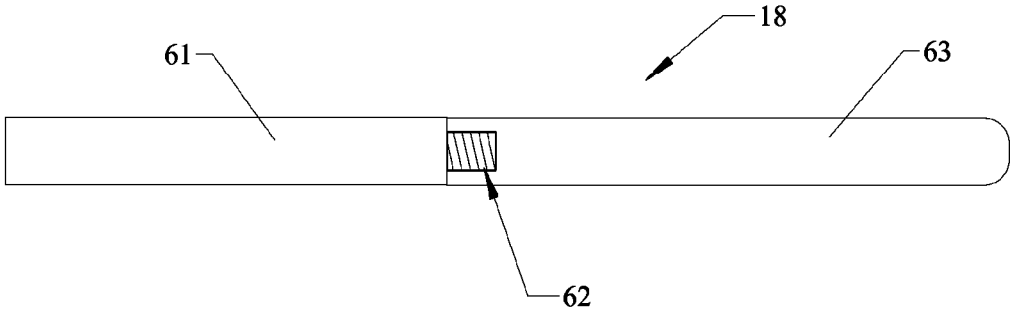
FIG. 7B is a side view of a connected sectioned handle of the tool of the present invention with the central section cut away to show the male and female threaded portions joined together.

In some embodiments, such as those shown in FIGS. 7A and 7B, handle 18 of tool 10 is sectioned to allow for compactness and easier storage of tool 10. Handle 18 includes sections 61 and 63 which securely attached to one another via connection 62. As shown in FIG. 7A, the preferred connection 62 is a hardware connection, such as the male threaded portion 65 of handle section 61 and the female threaded portion 67 of handle section 63. However, in other embodiments, connection 62 may take the form of a locking pin and clevis, a telescoping connector, or other art recognized connections that allow two sections of a handle to be shortened and lengthened. In FIG. 7A, handle 18 is unconnected and we see male threaded portion 65 part protruding from left section 61 and female threaded portion 67 indicated by dashed lines as being within right section 63. FIG. 7B shows handle 18 connected with the male and female screw parts of connection 62 united. In embodiments in which the right tine 25 has the angled tip 29, the connection 62 is preferably a left hand threaded connection as the lifting of the log 22 in the prescribed manner can loosen the connection 62 if it is a conventional right hand threaded connection. If the left tine 24 has the angled tip, a conventional right hand threaded connection is preferred.

Although the present invention has been described in considerable detail with reference to certain preferred versions thereof, other versions would be readily apparent to those of ordinary skill in the art. Therefore, the spirit and scope of the description should not be limited to the description of the preferred versions contained herein.

What is claimed is:

1. An integrated tool head for maneuvering a log comprising:

a metal, generally U-shaped body comprising two tines and a curved area:

wherein each of said two tines comprises a tine body, a tip having a tip end, and a tine end that joins with said curved area; and wherein one of said tips is a straight tip and one of said tips is an angled tip that forms an included angle between said tine body and said angled tip, wherein said angle causes said angled tip to be non-coplanar with a plane defined by said tine bodies of said two tines; and wherein said tine ends of each of said two tines join with said curved area at a second angle from a plane defined by said curved area; and a metal rod integral to and extending from said curved area of said U-shaped head.

2. The tool head as claimed in claim 1, wherein said included angle formed between said tine body and said angled tip is between 75° and 100°.

3. The tool head as claimed in claim 2, wherein said included angle formed between said tine body and said angled tip is substantially 90°.

4. The tool head as claimed in claim 1, wherein said included angle formed between said tine body and said angled tip occurs substantially one inch from said tip end of said angled tip.

5. The tool head as claimed in claim 1, wherein said second angle formed between said tine ends of each of said two tines and a plane defined by said curved area is between 150° and 160°.

6. The tool head as claimed in claim 1, wherein said metal rod comprises a non-integral end that is not integral to said curved area, and wherein said non-integral end comprises a threaded portion.

7. The tool head as claimed in claim 6, wherein said metal rod is a lag screw welded to said curved area of said U-shaped body.

8. The tool head as claimed in claim 7, wherein said lag screw has dimensions of ⅜" by 3".

9. The tool head as claimed in claim 6, wherein said metal rod further comprises a shank between said threading and an intersection of said metal rod and said curved area of said U-shaped body.

10. The tool head as claimed in claim 1, wherein said U-shaped body is made of rolled steel.

11. The tool head as claimed in claim 1, wherein each of said tips of said two tines is deburred, shaped, and slightly flattened.

12. The tool head as claimed in claim 1, wherein said U-shaped body is dimensioned such that said two tines are spaced at a distance at least as wide as a cross section of an average sized log at an angle of between forty five degrees and eighty five degrees from said plane defined by said tine bodies of said two tines.

13. The tool head as claimed in claim 12 wherein said distance between said two tines is between three inches and seven inches.

14. A tool for maneuvering a log comprising:

a tool head comprising:

a metal, generally U-shaped body comprising two tines and a curved area:

wherein each of said two tines comprises a tine body, a tip having a tip end, and a tine end that joins with said curved area; and wherein one of said tips is a straight tip and one of said tips is an angled tip that forms an included angle between said tine body and said angled tip, wherein said angle causes said angled tip to be non-coplanar with a plane defined by said tine bodies of said two tines; and wherein said tine ends of each of said two tines join with said curved area at a second angle from a plane defined by said curved area; and a metal rod integral to and extending from said curved area of said U-shaped head, comprising a non-integral end that is not integral to said curved area, wherein said non-integral end comprises threading;

a handle comprising a ferrule end and a non-ferrule end, wherein said handle is affixed to said metal rod of said tool head at said ferrule end; and a metal ferrule disposed upon said handle at said ferrule end of said handle.

15. The tool as claimed in claim 14, wherein said handle further comprises more than one section and connections between each section such that said handle is able to be connected, unconnected, and reconnected.

16. The tool as claimed in claim 14 wherein said included angle between said tine body and said angled tip is between 75° and 100°.

17. The tool as claimed in claim 14, wherein said metal rod further comprises a shank between said threading and an intersection of said metal rod and said curved area of said U-shaped body.

18. The tool as claimed in claim 14, wherein said second angle formed between said tine ends of each of said two tines and a plane defined by said curved area is between 150° and 160°.

19. The tool as claimed in claim 14, wherein said U-shaped body is dimensioned such that said two tines are spaced at a distance at least as wide as a cross section of an average sized log at an angle of between forty five degrees and eighty five degrees from said plane defined by said tine bodies of said two tines.

* * * * *